US012492067B2

(12) United States Patent
Avery et al.

(10) Patent No.: US 12,492,067 B2
(45) Date of Patent: Dec. 9, 2025

(54) STORAGE DEVICE FOR LENS FILTERS AND RELATED METHODS

(71) Applicant: Avery Optics LLC, Rossmoor, CA (US)

(72) Inventors: Ryan Avery, Los Alamitos, CA (US); Van Wampler, Glenwood Springs, CO (US); Colton Crandell, Centennial, CO (US)

(73) Assignee: Avery Optics LLC, Rossmoor, CA (US)

( * ) Notice: Subject to any disclaimer, the term of this patent is extended or adjusted under 35 U.S.C. 154(b) by 114 days.

(21) Appl. No.: 18/613,226

(22) Filed: Mar. 22, 2024

(65) Prior Publication Data

US 2024/0317484 A1 Sep. 26, 2024

Related U.S. Application Data

(60) Provisional application No. 63/491,788, filed on Mar. 23, 2023.

(51) Int. Cl.

| | |
|---|---|
| ***B65D 85/48*** | (2006.01) |
| ***B65D 6/00*** | (2006.01) |
| ***B65D 43/16*** | (2006.01) |
| ***B65D 43/22*** | (2006.01) |

(52) U.S. Cl.

CPC ..... *B65D 85/48* (2013.01); *B65D 11/10* (2013.01); *B65D 43/163* (2013.01); *B65D 43/22* (2013.01)

(58) Field of Classification Search

CPC ..... B65D 85/30; B65D 85/48; B65D 11/00; B65D 11/02; B65D 11/10; B65D 43/14; B65D 43/16; B65D 43/163; B65D 43/22

See application file for complete search history.

(56) References Cited

U.S. PATENT DOCUMENTS

| | | | | |
|---|---|---|---|---|
| 7,299,920 | B2 * | 11/2007 | Osborn | G11B 33/0427 |
| 10,054,992 | B1 * | 8/2018 | Ehlen | H05K 5/0282 |
| 2022/0355978 | A1 * | 11/2022 | Hoshino | B65D 11/10 |

FOREIGN PATENT DOCUMENTS

| | | | | |
|---|---|---|---|---|
| WO | WO-2008028479 | A1 * | 3/2008 | G02B 26/007 |
| WO | WO-2009050800 | A1 * | 4/2009 | B65D 85/38 |

* cited by examiner

*Primary Examiner* — Javier A Pagan
(74) *Attorney, Agent, or Firm* — Alumen IP Law PC

(57) ABSTRACT

A storage device for a cinematography lens filter used with the lenses of video recorders and cameras is disclosed. The storage device may have a casing and a lid. The casing may have a two-part body including a first casing enclosure and a second casing enclosure, the two-part body having a latch receiver near an angled top opening of the two-part body. The lid may be attached to the casing and also have a two-part body including a first lid section and a second lid section, the lid having a latch on a lid side edge and an angled bottom opening that inclines upward towards the latch.

20 Claims, 7 Drawing Sheets

STORAGE DEVICE FOR LENS FILTERS AND RELATED METHODS

FIELD OF ART

The field of the invention relates to storage devices for cinematography lens filters for the lenses of video recorders and cameras.

BACKGROUND

Video recorders and cameras are used professionally and recreationally to capture recordings and images in certain lighting and coloring aspects. To facilitate capturing desired images, filter lenses having certain modifiable imaging features may be used, such as lenses with UV filters, polarizing filters, and color correcting filters. When not installed to the video recorder or camera, these filter lenses should be stored in a safe place.

SUMMARY

A storage device for a cinematography lens filter used with lenses of video recorders and cameras is disclosed. Broadly speaking, the storage device may have a casing and a lid. The casing may have a two-part body including a first casing enclosure and a second casing enclosure, the two-part body having a latch receiver near an angled top opening of the two-part body. The lid may be attached to the casing and also has a two-part body including a first lid section and a second lid section, the lid having a latch on a lid side edge and an angled bottom opening that inclines upward towards the latch.

While both the casing and the lid may have inclined openings or angled openings, when the lid closes the opening of the casing, the overall outer periphery can be generally rectangular, with two opposing sides and two opposing ends.

Because the casing has an angled top opening and the lid has an angled bottom opening, each of the two components has one side edge that is longer than the other side edge. The lid can be hinged to the casing on the longer of the two side edges so that the lid has a shorter or shallower swing to enclose over the casing, which helps with clearance when a lens filter is located inside the interior of the casing.

Aspects of the present invention include a storage device for a cinematography lens filter comprising: a casing made from a first material having a two-part body including a first casing enclosure and a second casing enclosure joined together along a parting line and defining a first storage slot, the two-part body having a latch receiver near an angled top opening of the two-part body, the angled top opening inclining upwards towards the latch receiver; a lid attached to the casing and having a two-part body including a first lid section and a second lid section joined together along a parting line and defining a second storage slot, the lid having a latch on a lid side edge and an angled bottom opening that inclines upward towards the latch; a first insertable strip located in the first storage slot and a second insertable strip located in the second storage slot; and wherein the first insertable strip is made from a second material having a hardness value that is lower than a hardness value of the first material.

The latch can be unitarily formed with the first lid section or the second lid section.

The latch can have a hook end.

The latch can have a push tab at an opposite end of the body from the hook end.

The latch can be connected to the lid side edge by a branch having two ends. The two ends of the branch can connect to the lid and the latch at two different elevations. The two ends can have arcuate or curved sections.

The latch can have an extended push end opposite the hook end, and wherein the push end is pressable to move the hook end.

The casing of the storage device can include magnetic parts so that multiple storage devices can magnetically attract and be stacked horizontally and vertically while magnetically attached to one another.

The magnetic parts can be located in magnetic storage areas formed through a thickness of the casing. For example, a magnet can be held in a slot or a boss formed in the casing, the lid, or both.

The first casing enclosure can have a first external surface with a first protruding pattern and the second casing enclosure can have a second external surface with a second protruding pattern.

The first and second protruding patterns can be symmetrically opposite one another about a plane at the parting line.

The first protruding pattern can comprise a first plurality of spaced apart stripes and the second protruding pattern can comprise a second plurality of spaced apart stripes.

The first casing enclosure can have a planar external surface, a plurality of protruding dashed stripes projecting away from the planar external surface, and a recess surface that is recessed from the planar external surface at the angled top opening.

The second casing enclosure can have a planar external surface, a plurality of protruding dashed stripes projecting away from the planar external surface, and a recess surface that is recessed from the planar external surface at the angled top opening.

The recess surface of the first external surface and the recess surface of the second external surface can project into the angled bottom opening of the lid.

The latch can be attached to the casing by a hinge mechanism comprising a pivot pin.

The pivot pin can project through two pivot holes of the casing.

The pivot pin can project into two holding bores having closed ends on the lid.

The casing can have two side edges including a first side edge and a second side edge. The first and second enclosure sections can be secured to one another adjacent or at the first and second side edges.

A plurality of spaced apart flared tabs can extend outwardly from the first side edge and each flared tab can comprise a receiving boss.

A plurality of flared tabs can extend outwardly from the second side edge and each flared tab can comprise a receiving boss.

A fastener can pass through each of the receiving bosses.

Each flared tab can comprise a flared tab first section attached to the first casing enclosure and a flared tab second section attached to the second casing enclosure.

The flared tab sections can be unitarily formed with the first and second casing enclosures, respectively.

The first side edge of the casing can have three flared tabs and the second side edge of the casing can have three flared tabs. The bottom edge of the casing can have two flared tabs.

The first storage slot of the casing can have two side railings defining a width, and wherein a cinematography lens filter can be located inside the first storage slot and is spaced from at least one of two side railings. The first storage slot can include a lip or a step to create a depth so that the first and second opposing surfaces of the lens filter do not contact inside surfaces of the casing.

A bottom edge of the cinematography lens filter can contact a first strip and a top edge of the cinematography lens filter can contact a second strip when the lid is in a closed position and engaging the casing.

The first strip and the second strip can be made from a foam material.

The two side railings can be sized and shaped to contact only a portion of an outer perimeter of the cinematography lens filter.

Portions of an end edge and portions of a side edge of a cinematography lens filter can be exposed when the lid is rotated to an open position.

The casing and the lid can be made from a rigid polymer compound.

The rigid polymer compound can be nylon 66.

The casing and the lid can be made from a composite material, such as from polypropylene and glass fiber.

The rigid polymer compound can be a thermoplastic polyolefin material.

The second storage slot of the lid can be sized to accommodate at least 12% of the cinematography lens filter volume.

A length of the storage device can be between 4 to 7 inches and a width of the storage device can be between 2.5 to 5 inches.

The casing can have first and second casing enclosures that can be detachable from one another. Fasteners can be removed to detach the first and second casing enclosures from one another.

The lid can be made from first and second lid sections. The first lid section can be detachable from the second lid section. Fasteners can be removed to detach the first and second lid sections from one another.

The first casing enclosure can be attached to the second casing enclosure using a first set of fasteners, and the first lid section can be attached to the second lid section using a second set of fasteners.

The fasteners can be screws or bolts comprising a head and a shank.

The first casing enclosure can be interlocked to the second casing enclosure.

The first lid section can be interlocked to the second lid section.

The first casing enclosure can be attached to the second casing enclosure using an adhesive compound.

Another aspect of the invention can include a storage device for a cinematography lens filter, comprising: a first casing enclosure, said first casing enclosure having a first side edge, a second side edge, a bottom edge, a first angled top edge, and a continuous lip structure protruding outwards from an inner surface of the first casing enclosure and extending along the first side edge, the bottom edge, and the second side edge of the first casing enclosure; the first angled top edge inclining upwards from the first side edge of the first casing enclosure having a first hinge section to the second side edge of the first casing enclosure having a first portion of a latching mechanism; the continuous lip structure making up railings along the first and second side edges of the first casing enclosure, the railings configured to receive cinematography lens filter side edges, the continuous lip structure forming part of an interior space for accommodating a first insertable strip proximate the bottom edge of the first casing enclosure; a second casing enclosure attachable to the first casing enclosure, said second casing enclosure having a first side edge, a second side edge, a bottom edge, and a second angled top edge inclining upwards from the first side edge of the second casing enclosure having a second hinge section to the second side edge of the second casing enclosure; and a lid having a top edge, an angled bottom edge, a first lid side, a second lid side, the angled bottom edge of the lid inclining upwards from the first lid side to the second lid side so as to conform and align with the first and second angled top edges, the second lid side having a second portion of the latching mechanism and a second insertable strip located in an interior of the lid.

A still further aspect of the invention can include a storage device for a cinematography lens filter, comprising: a casing having a two-part body including a first casing enclosure and a second casing enclosure joined together along a first parting line and defining a first storage slot with railings on a right inside side edge and a left inside side edge, the two-part body having a first portion of a latching mechanism near a top opening; and a rotatable lid attached to the casing and having a two-part body including a first lid section and a second lid section joined together along a second parting line and defining a second storage slot, the rotatable lid having a second portion of the latching mechanism on a lid side edge.

Additional aspects of the disclosed storage device are shown in the attached drawings and detailed below, including in the claims. Aspects of the invention further include methods of using and manufacturing storage devices for lens filters.

BRIEF DESCRIPTION OF THE DRAWINGS

These and other features and advantages of the present devices, systems, and methods will become appreciated as the same becomes better understood with reference to the specification, claims and appended drawings wherein:

DETAILED DESCRIPTION

The detailed description set forth below in connection with the appended drawings is intended as a description of the presently preferred embodiments of storage devices provided in accordance with aspects of the present devices, systems, and methods and is not intended to represent the only forms in which the present devices, systems, and methods may be constructed or utilized. The description sets forth the features and the steps for constructing and using the embodiments of the present devices, systems, and methods in connection with the illustrated embodiments. It is to be understood, however, that the same or equivalent functions and structures may be accomplished by different embodiments that are also intended to be encompassed within the spirit and scope of the present disclosure. As denoted elsewhere herein, like element numbers are intended to indicate like or similar elements or features.

Descriptions of technical features or aspects of an exemplary configuration of the disclosure should typically be considered as available and applicable to other similar features or aspects in another exemplary configuration of the disclosure. Accordingly, technical features described herein according to one exemplary configuration of the disclosure may be applicable to other exemplary configurations of the disclosure, and thus duplicative descriptions may be omitted herein.

Figure 1B:
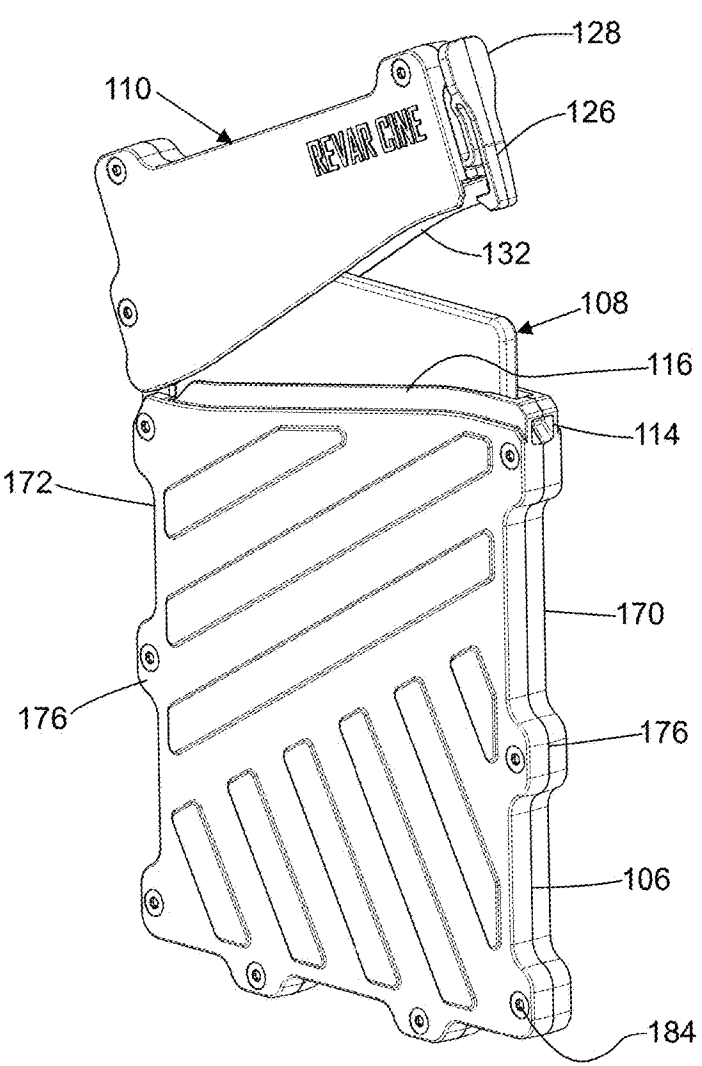
FIG. 1B is a second perspective view of a storage device for a cinematography lens filter in an open position, in accordance with aspects of the invention.
Figure 1A:
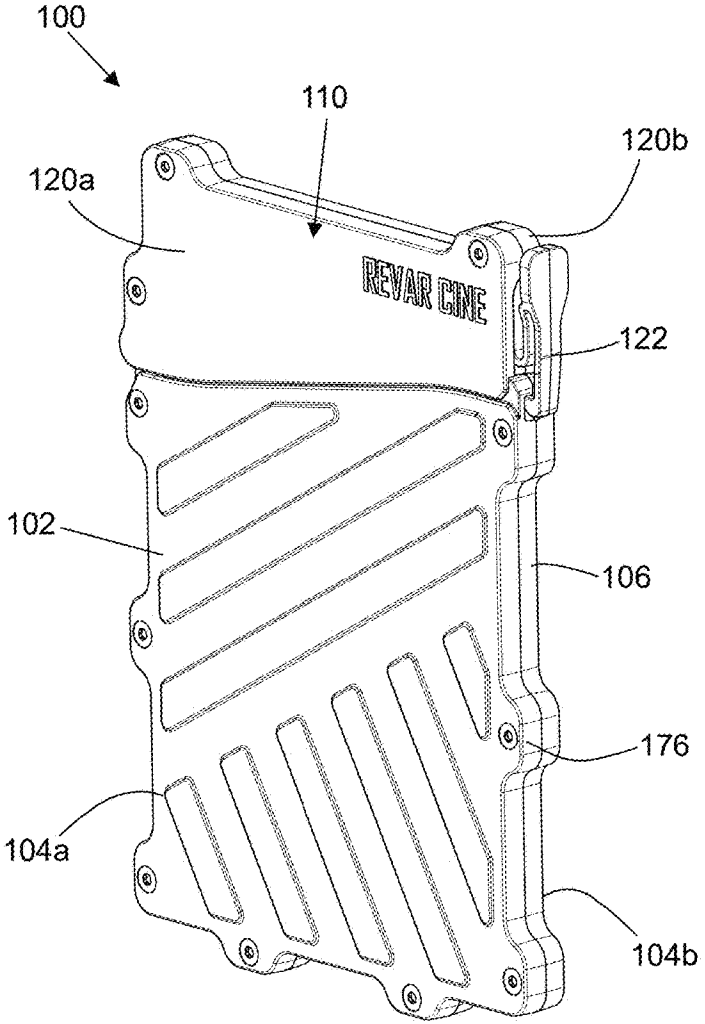
FIG. 1A is a first perspective view of a storage device for a lens filter in a closed position, in accordance with aspects of the invention.

A storage device for a lens filter, specifically a cinematography lens filter, is disclosed herein. With reference initially to FIGS. 1A and 1B, the storage device 100 in accordance with aspects of the invention may have a casing 102 comprising a two-part body that includes a first casing enclosure 104*a* and a second casing enclosure 104*b* joined together along a parting line 106. The two views show the storage device 100 in a closed position and in a partially opened position, with the lid 110 pivoted away from the casing 102. The spacing between the first and second casing enclosures defines a first storage slot for accommodating or storing at least part of a lens filter 108. The body of the casing can have a latch receiver 114 near an angled top opening 116 of the casing 102. The angled top opening 116 of the casing 102 may incline upwards towards the latch receiver 114. The casing may be made from a thermoplastic or an engineered plastic material, which may be referred to as a first material.

In an example, the storage device 100 may have a lid 110 attached to the casing 102. The lid 110 may also have a two-part body that includes a first lid section 120*a* and a second lid section 120*b* joined together along a parting line 122. The parting line 106 of the casing 102 may be referred to as the first parting line and the parting line 122 of the lid may be referred to as the second parting line. The spacing between the first lid section 120*a* and the second lid section 120*b* may define a second storage slot for storing or accommodating at least part of the lens filter 108. The lid 110 may have a latch 126 on a lid side edge 128 and an angled bottom opening 132 that inclines from a pivot end upward towards the latch 126. The angled bottom opening 132 of the lid and the angled top opening 116 of the casing 102 are sized, shaped, and contoured to mate so that the outer contour of the storage device 100 is generally cuboid. The lid 110 may also be made from the first material. In another example, the latch 126 of the lid 110 and the latch receiver 114 of the casing 102 may be interchanged or reversed so that the lid incorporates the latch receiver and the casing incorporates the latch.

Figure 4:
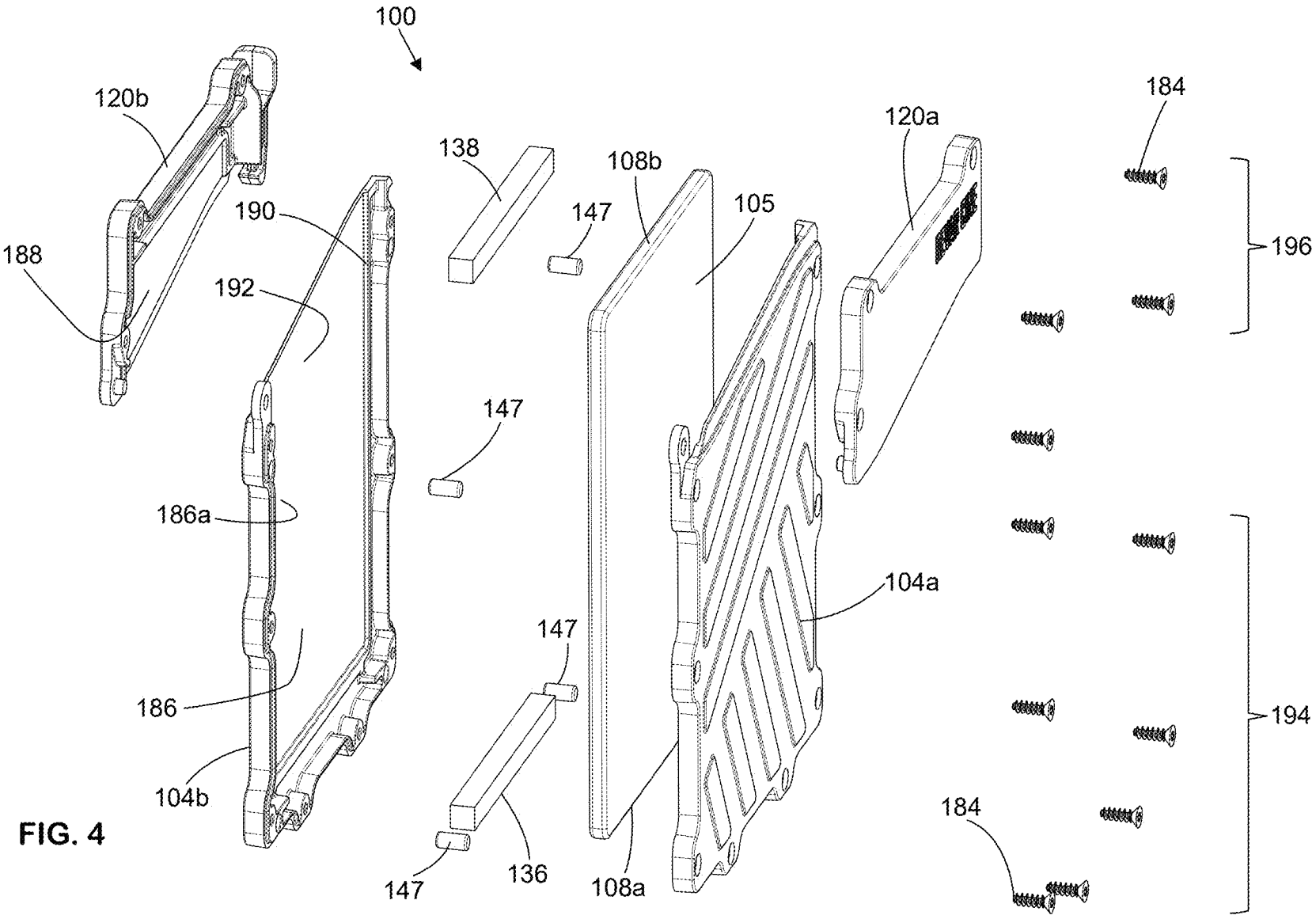
FIG. 4 is a first exploded perspective view of the storage device, in accordance with aspects of the invention.

A lens filter 108, such as shown in FIG. 4 and partially shown in FIG. 1B, can be located inside the first storage slot of the two-part casing. The two-part lid can then close over the opening 116 of the casing 102 to enclose the lens filter 108 inside the storage device 100. As further discussed below, the two part enclosures 104*a*, 104*b* and the two part lid sections 120*a*, 120*b* can be held or secure respectively to one another by fasteners or screws.

In an example, for use as biasing members to constrain the lens filter 108 within the enclosed storage device 100, pliable or biasing strips may be used. A first strip 136 (FIG. 4) may be positioned in the first storage slot of the casing 102 and a second strip 138 may be located in the second storage slot of the lid 110. The strips are inserted into the respective slots after the casing and the lid are assembled or can be placed in between the two part enclosures of the lid and the casing during their assembly. The two strips 136, 138 can be made from a high density foam material. Other foam materials may be used, such as gel-infused memory foam, open and closed-cell foams, cross-linked polyethylene foam, rubber foams, PVC foams, polyurethane, and other physically similar foam materials. Once located inside the casing and the lid, the spacing between two strips 136, 138 is less than the length of the lens filter 108, such as by about ⅛-inch to about ⅜-inch, or other lengths depending on the material and compressibility of the strips, to apply a soft compressive force to two edges 108*a*, 108*b* of the lens filter 108 and prevent the lens filter from shifting within the storage device when closing the opening of the casing with the lid.

In some examples, the strips 136, 138 provide cushions for the lens filter in case the lens filter shifts back-and-forth or up-and-down within the storage device. In some examples, the strips 136, 138 can be confined within the casing 102 and the lid 110 using tabs, shoulders, baffles, by compressive constraint within the interior spaces of the lid and the casing, or combinations thereof. In some instances, the tabs or shoulders can appear as designated cavities in the inside bottom of the casing and the inside top of the lid for securing the strips inside the respective units. The first and second strips 136, 138 may be made from a second material. The second material may have a hardness value that is lower than a hardness value of the first material Used to make the casing and/or lid. The first material may be rigid, and the second material may be flexible. For example, the first material can be a hard plastic while the second material can be a foam material.

Figure 3B:
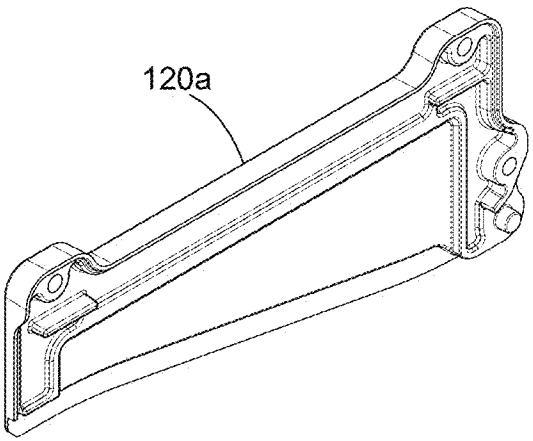
FIG. 3B is a perspective view of an interior of the second lid section of the storage device, in accordance with aspects of the invention.
Figure 3A:
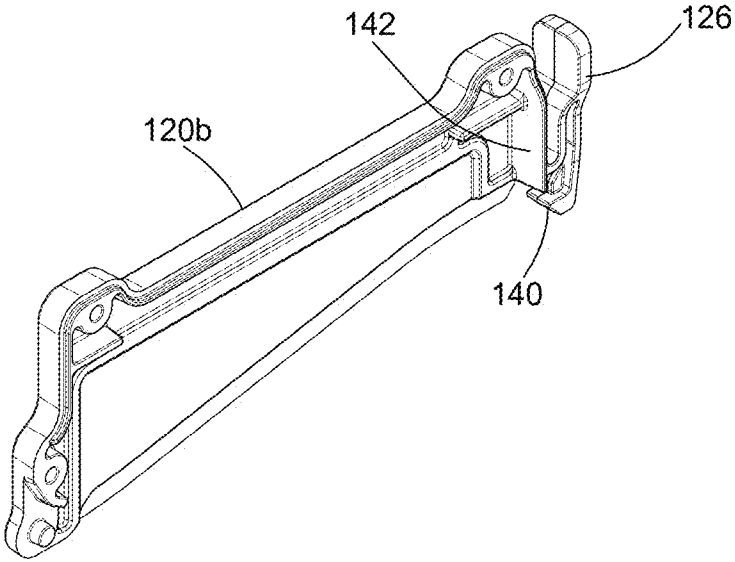
FIG. 3A is a perspective view of an interior of a first lid section of the storage device, which has been separated from a second lid section, in accordance with aspects of the invention.
Figure 6:
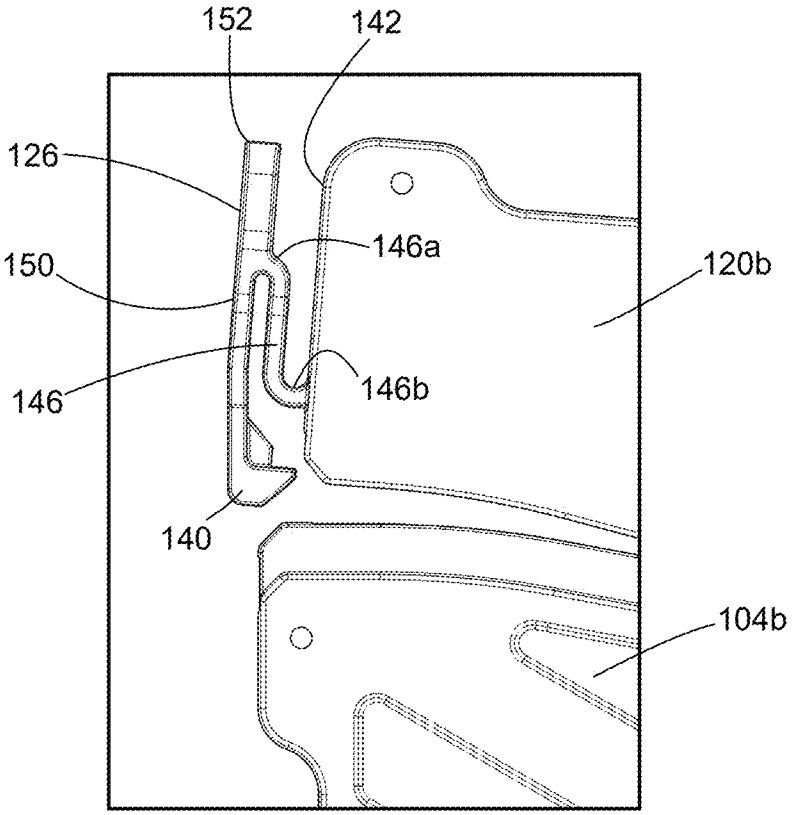
FIG. 6 is a close-up view of the latching mechanism of the storage device, in accordance with aspects of the invention.

In an example, the latch 126 of the storage device 100 may be unitarily formed with the first lid section 120*a* or the second lid section 120*b*. With reference to FIGS. 3A and 3B, the first section 120*a* and the second lid section 120*b* are shown in a separated state to show the latch 126. As shown, the latch is unitarily formed with the second lid section 120*b*. In an example, the latch has a hook end 140. With further reference to FIG. 6, which is an enlarged partial of the second lid section 120*b*, the latch 126 is connected to the lid side edge 142 by a branch 146, which has a first branch end 146*a* connected to the lid side edge 142 and a second branch end 146*b* connected to the latch body 150. The two ends 146*a*, 146*b* can be arcuate or has sections that are curved. The branch 146 can be connected to the latch body 150 at a point between two ends of the latch body. As shown, the latch 126 has a push end 152 opposite the hook end 140.

The first branch end 146*a* is attached to the latch body 150 at a point along the length of the latch body that is closer to the push end than the hook end. Elevation-wise when the storage container 100 is stood up vertically, the second branch end 146*b* is connected to the lid side edge 142 at a point on the side edge that is lower than location of the first branch end 146*a*. Said differently, the branch 146 has a length and when the length is oriented vertically, the first branch end 146*a* is higher than the second branch end 146*b*.

The two connection points at the first branch end 146*a* and the second branch end 146*b* serve as two flex points to enable the hook end 140 to flex in and out of engagement with the latch receiver 114 (FIG. 1B) when the push end 152 of the latch is pushed. Moving the hook end 140 can release the hook end from the receiving slot or latch receiver on the casing 102 to enable opening of the lid 110. In less preferred embodiments, the first latching mechanism, such as the latch 126, with the hook end 140 can be incorporated with the casing 102 and the receiving slot or latch receiver 114, for receiving the hook end can be located on the lid 102.

In an example, the casing 102 may have magnetic parts or components to facilitate stacking of multiple storage devices 100. For example, a cameraman may have two or more lens filters located in separate storage devices 100 that are to be stacked horizontally or vertically for storage. Magnets 147 (FIG. 4) can be placed within a plurality of spaced apart cavities of a storage device 102 so that when another storage device is stacked thereon or thereagainst, opposite magnetic poles between adjacent storage devices can help to stack or retain them together via magnetic attraction. In an example, the magnetic parts may be located in magnetic storage areas or cavities formed through the thickness of the respective casing. In some examples, magnetic parts can be used to first magnetically couple the first and second enclosures together to then e more permanently secured, such as by using fasteners, welding, bonding, and/or irreversible detents In an example and with reference to FIGS. 7A and 7B, the first casing enclosure 104*a* may have a first external surface 156 with a first protruding pattern 158 and the second casing enclosure 140*b* may have a second external surface 160 with a second protruding pattern 162. In an example, the first and second protruding patterns may be symmetrically opposite one another about a plane at the parting line 106 (FIG. 1B). In an example, the first protruding pattern 158 may have a first plurality of spaced apart stripes and the second protruding pattern 162 may have a second plurality of spaced apart stripes. In an example, the first casing enclosure 104*a* may have a planar external surface 156, a plurality of protruding dashed stripes projecting away from such planar external surface, and a recess surface that may be recessed from the planar external surface at the angled top opening of the casing. In an example, the second casing enclosure 104*b* may have a planar external surface 160, a plurality of protruding dashed stripes projecting away from such planar external surface, and a recess surface that may be recessed from the planar external surface at the angled top opening. In an example, the recess surface of the first external surface and the recess surface of the second external surface may project into the angled bottom opening of the lid. In other examples, the protruding patterns 158, 162 of the two enclosures may embody different designs than the protruding strips, or each enclosure section can have a different decorative pattern from the other.

Figure 2B:
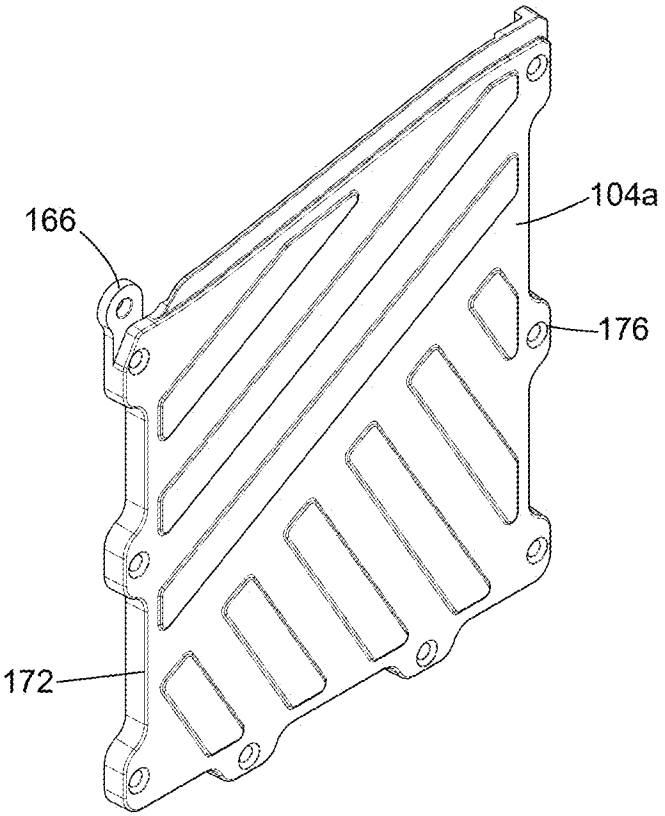
FIG. 2B is a perspective view of an exterior of the second casing enclosure of the storage device, in accordance with aspects of the invention.
Figure 2A:
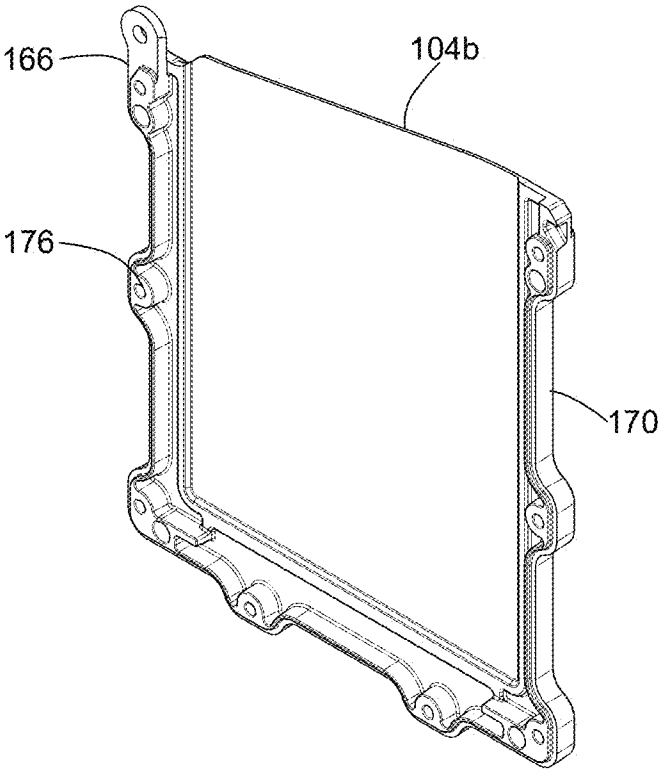
FIG. 2A is a perspective view of an interior of a first casing enclosure of the storage device, which has been separated from a second casing enclosure, in accordance with aspects of the invention.

In an example, the lid 110 may be attached to the casing 102 (FIG. 1A) by a hinge mechanism having a pivot pin. FIGS. 2A and 2B show a hinge extension 166 mounted to each of the first casing enclosure 104*a* and second casing enclosure 104*b*. The hinge extension 166 resembles an inner attachment of a bicycle chain in that it has a body with two spaced apart holes. The first of two holes on the hinge extension 166 can snap fit onto a projection or pin on the respective casing enclosure or a pin can project through the first of two holes and a hole in the respective casing enclosure to retain the hinge extension 166 to the respective casing enclosure. In alternative examples, the hinge extension 166 can be unitarily formed with the respective casing enclosure, in which case the hinge extension 166 only has a single hole or opening.

When the first and second enclosures 104*a*, 104*b* are joined together, the two hinge extensions 166 present an anchor with a common hole or opening through the bodies of the two hinge extensions. The lid 110 (FIG. 1A) can then hingedly attach to the two hinge extension by projecting a pivot pin through the aligned pivot holes of the lid and the hinge extensions on the casing 102. In an example, the pivot pin may project into two holding bores having closed ends on the lid. For example, the lid can have a pivot pin formed with one of the lid sections and when the two lid sections are joined, the pin project through the aligned holes on the two hinge extensions and then the two lid sections are secured together using fasteners, as further discussed below. In some examples, holes of the casing and the lid can align, and a pivot pin can be projected through the holes from an exterior and passing through all the holds to form a pivot joint.

Figure 7B:
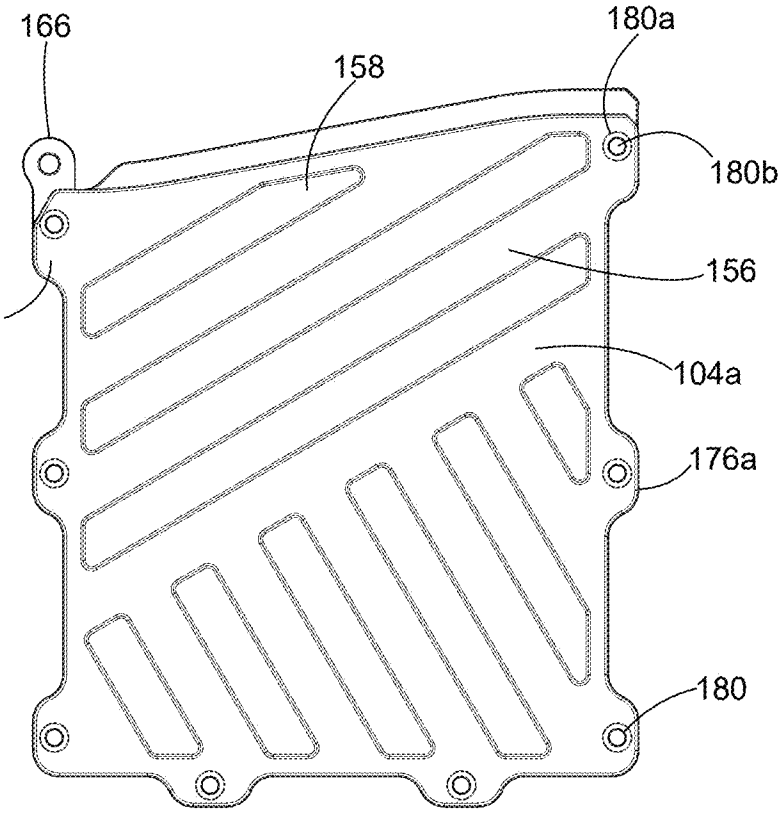
FIG. 7B is a plan view of an exterior of the second casing enclosure of the storage device, in accordance with aspects of the invention.
Figure 7A:
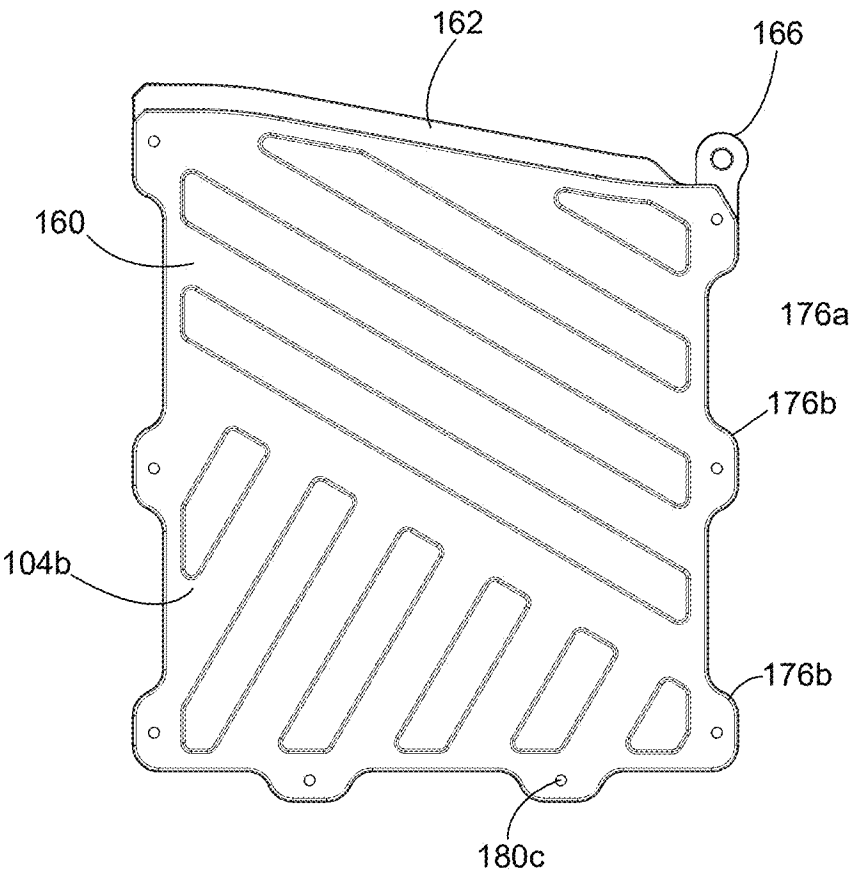
FIG. 7A is a plan view of an exterior of the first casing enclosure of the storage device, in accordance with aspects of the invention.

In an example, the casing may have two side edges 170, 172 that include a first side edge 170 and a second side edge 172, and a plurality of flared tabs 176 may extend outwardly from the first and second side edges 170, 172 and each flared tab may have a receiving boss 180 (FIG. 7B). With reference to FIGS. 7A and 7B, each flared tab 176 has two flared tab sections 176*a*, 176*b*, one on each of the two casing enclosures 104*a*, 104*b*. As shown, the receiving boss 180 on the first flared tab section 176*a* has an enlarged first bore section 180*a* and a reduced section bore section 180*b*. The first bore section 180*a* can be viewed as a countersink or counterbore and the second bore section 180*b* can be viewed as a through bore. The bore 180*c* on the second flared tab section 176*b* can be a female threaded bore.

In an example, a plurality of fasteners 184 may pass through the plurality of receiving boss 180 to secure the two casing enclosures 104*a*, 104*b* together, with one fastener 184 used for each receiving boss 180. The fastener 184 may be a screw or a bolt having a head and a threaded shank. The threaded shank can thread to the female threaded bore 180*c* on the second flared tab section 176*b* while screw head or bold head is recessed within the enlarged first bore section 180*a* on the first flared tab section 176*b*. Thus, fasteners or screws may be means for securing the two part body of the casing 102 and the lid together.

In an example, each of the flared tabs may have a flared tab first section 176*a* attached to the first casing enclosure 104*a* and a flared tab second section 176*b* attached to the second casing enclosure 104*b*. In an example, the first side edge 170 of the casing 102 may have two to six flared tabs, the second side edge 172 of the casing 102 may have two to six flared tabs, and a bottom edge of the casing may have two to four flared tabs. The lid 100 may have a similar configuration but with fewer flared tabs. In an example, the lid may have one to three flared tabs along the upper edge, and one to three flared tabs along a side edge. Preferably, only one side edge of the lid incorporates flared tabs.

In some examples, both the casing 102 and the lid 110 can have straight sides, without flared tabs. Instead, a continuous lip can protrude from an interior surface of the casing and the lid. The continuous lip may have a generally constant width around three sides of the periphery of the first and second enclosures and first and second lid sections. Then receiving bosses can be formed within the width of the continuous lip for receiving screws or fasteners to secure the pair of enclosures and lid sections together.

Figure 5:
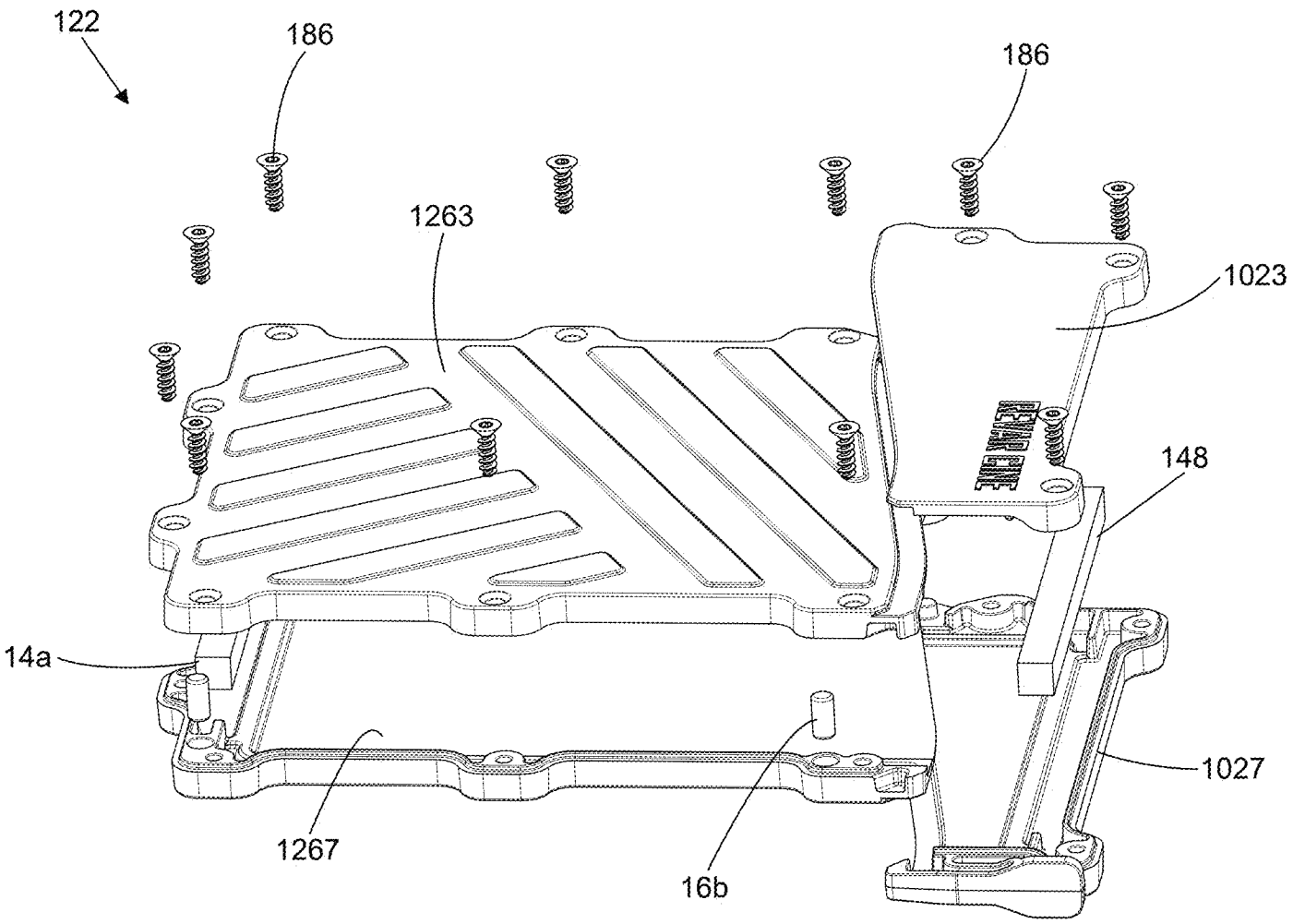
FIG. 5 is a second exploded perspective view of the storage device, in accordance with aspects of the invention.

FIGS. 4 and 5 are different exploded views of the casing 102 and lid 110 of FIGS. 1A and 1B. In the exploded view shown, the first storage slot 186 of the casing 102 defined by the first and second casing enclosures 104*a*, 104*b* and the second storage slot 188 of the lid 110 defined by the first and second lid sections 120*a*, 120*b* are partially shown. In an example, the first storage slot 186 of the casing may have two side railings 186*a*, 186*b* defining a width, and cinematography lens filter may be located inside the first storage slot 186 and may be spaced from at least one of two side railings. That is, the width of the first storage slot 186 can be larger than the width of the lens filter so that their relative sizes can avoid contact between the two when sliding the lens filter into the first storage slot. In an example, the two side railings 186*a*, 186*b* may approximately align with the side surfaces of the first and second strips 136, 138. When the lens filter 108 is placed into the first storage slot 186, the bottom edge 108*a* of the cinematography lens filter may contact the first strip 136 and a top edge 108*b* of the cinematography lens filter may contact the second strip 138 when the lid 110 is in a closed position.

When the lid is closed over the opening of the casing as shown in FIG. 1A, the two strips 136, 138 can apply a compressive force to the lens filter 108 to keep the filter from sliding or shifting within the storage device 100, such as to constrain the lens filter within the storage device 100. In an example, the first strip 136 and the second strip 138 may be made from a plastic foam material. In some examples, the two side railings 186*a*, 186*b* of the casing may contact a portion of an outer perimeter of the cinematography lens filter 108 but the casing generally does not contact first and second surfaces 105, 107 of the lens filter 108. This spacing relationship may be practiced by incorporating a lip 190 adjacent the side rails 186*a*, 186*b* to increase the depth or spacing of first storage slot 186 between the two opposing inside surfaces of the two casing enclosures 104*a*, 104*b*. The lid 110 may be practiced in the same manner. In an example, portions of an end edge and portions of a side edge of the cinematography lens filter may be exposed when the lid is rotated to an open position, as shown in FIG. 1B.

In an example, the casing 102 and the lid 110 of the storage device 100 may be made from a rigid polymer compound. In an example, the rigid polymer compound may be nylon 66. In an example the rigid polymer compound may be a thermoplastic polyolefin material. In an example the casing 102 and the lid 110 of the storage device 100 may be made from a composite material. In an example, the composite material may be made from polypropylene and glass fiber. In an example, the casing and the lid of the storage device may be made from a metallic material, such as an aluminum or steel alloy. In some examples, the casing and the lid may be made from different rigid materials from one another.

In an example, the second storage slot 188 of the lid 110 may be sized to accommodate at least 10% to 25% of the cinematography lens filter volume with about 16% of the cinematography lens filter volume being preferred. In an example, an overall length of the storage device 100 may be between about 4 to 8 inches and a width of the storage device may be between about 2.5 to 6 inches. The depth of the storage device may be about 0.5 inch to about 1-inch. However, other sized storage devices is contemplated. In some examples, the storage device 100 can be structure to accommodate more than one lens filter. Appropriate shoulders, lips, ribs, and/or baffles may be incorporated to retain the two or more lens filter inside the casing while keeping them in a spaced apart relationship so that their respective first and second surfaces 105, 107 do not contact In an example, the first casing enclosure 104*a* of the storage device 100 may be detachable from the second casing enclosure 104*b*. In an example, the first lid section 120*a* of the lid 110 may be detachable from the second lid section 120*b*. In an example, the first casing enclosure 104*a* may be attached to the second casing enclosure 104*b* using a first set of fasteners 194 (FIG. 4), and the first lid section 120*a* may be attached to the second lid section 120*b* using a second set of fasteners 196. In an example, the fasteners may be screws. In an example, the first casing enclosure 104*a* may be interlocked to the second casing enclosure 104*b* without fasteners, such as by using interlocking detents. In an example, the first lid section 120*a* may be interlocked to the second lid section 120*b*, such as by using interlocking detents. In an example, the first casing enclosure is attached to the second casing enclosure and the first lid section is attached to the second lid section using an adhesive compound. In an example, the first casing enclosure may be welded to the second casing enclosure and the first lid section may be welded to the second lid section.

In another example, the storage device 100 for a lens filter, specifically a cinematography lens filter 108, may have a first casing enclosure that has a first side edge, a second side edge, a bottom edge, a first angled top edge, and a continuous lip structure protruding outwards from an inner surface of the first casing enclosure and extending along the first side edge, the bottom edge, and the second side edge of the first casing enclosure. The first angled top edge of the first casing enclosure may incline upwards from the first side edge having a first hinge section to the second side edge having a first portion of a latching mechanism. The continuous lip structure of the first casing enclosure may make up railings along the first and second side edges of the first casing enclosure. The railings may be configured to receive cinematography lens filter side edges. The continuous lip structure may form part of an interior space for accommodating a first insertable strip proximate the bottom edge of the first casing enclosure.

In some examples, the storage device 100 may incorporate one or more see through windows to enable viewing into the first storage slot or space. For example, the casing 102 may include one or more see through windows. The one or more see through windows may be covered by a clear thermoplastic material, which may be secured, fastened, glued, bonded, or molded to the casing of the storage device. In some examples, the lid 110 may include one or more see through windows.

In an example, the storage device may have a second casing enclosure attachable to the first casing enclosure. The second casing enclosure may have a first side edge, a second side edge, a bottom edge, and a second angled top edge inclining upwards from the first side edge of the second casing enclosure, which may have a second hinge section, to the second side edge of the second casing enclosure. In another example, the second casing enclosure may have the same features as the first casing enclosure.

In an example, the storage device may have a lid having a top edge, an angled bottom edge, a first lid side, and a second lid side. The angled bottom edge of the lid may incline upwards from the first lid side to the second lid side so as to conform and align with the first and second angled top edges of the casing. The second lid side may have a second portion of the latching mechanism and a second insertable strip located in an interior of the lid.

In another example, the storage device for a lens filter, specifically a cinematography lens filter, may have a casing having a two-part body including a first casing enclosure and a second casing enclosure joined together along a first parting line. The spacing between the first casing enclosure and the second casing enclosure may define a first storage slot having railings on a right inside side edge and a left inside side edge. The two-part body of the storage device may have a first portion of a latching mechanism near a top opening.

In an example, the storage device may have a rotatable lid attached to the casing and also have a two-part body including a first lid section and a second lid section joined together along a second parting line. The spacing between the first and second lid sections may define a second storage slot. The rotatable lid may have a second portion of the latching mechanism on a lid side edge.

In an example, an interface between the lid and the casing is angled from a hinge end at a first side edge of the casing and inclining towards a latched end at a second side edge of the casing. In an example, a first strip is located inside a first strip cavity within the first storage slot and a second strip is located inside a second strip cavity within the second storage slot. The first strip cavity may be proximate to the bottom edge of the casing, and the second strip cavity may be proximate to the top edge of the rotatable lid. Alternatively, the strips may be retained within the casing and the lid using adhesive instead of or in combination with the tabs or shoulders. In other examples, the strips are retained within the casing 102 and the lid 110, respectively, using only compressive or relative sizes.

In an example, the first casing enclosure may have substantially the same features and components as the second casing enclosure, and vice versa. In an example, the first lid section may have substantially the same features as the second lid section, and vice versa. In an example, the first strip may have substantially the same features as the second strip, and vice versa.

Methods of making and of using the storage device for cinematography lens filters and their components are understood to be within the scope of the present disclosure.

Although limited embodiments of lens filter storage device, assemblies, and their components have been specifically described and illustrated herein, many modifications and variations will be apparent to those skilled in the art. For example, the lens filter storage device may incorporate custom paint, have different outer contoured shapes, provided with overcoats, etc. Furthermore, it is understood and contemplated that features specifically discussed for one lens filter storage device embodiment may be adopted for inclusion with another lens filter storage device embodiment, provided the functions are compatible. Accordingly, it is to be understood that the lens filter storage device, assemblies, and their components constructed according to principles of the disclosed device, system, and method may be embodied other than as specifically described herein. The disclosure is also defined in the following claims.

What is claimed is:

1. A storage device for a cinematography lens filter, comprising:

a casing made from a first material having a two-part body including a first casing enclosure and a second casing enclosure joined together along a parting line and defining a first storage slot, the two-part body having a latch receiver near an angled top opening of the two-part body, the angled top opening inclining upwards towards the latch receiver;

a lid attached to the casing and having a two-part body including a first lid section and a second lid section joined together along a parting line and defining a second storage slot, the lid having a latch on a lid side edge and an angled bottom opening that inclines upward towards the latch;

a first strip located in the first storage slot and a second strip located in the second storage slot; and wherein the first strip is made from a second material having a hardness value that is lower than a hardness value of the first material.

2. The storage device of claim 1, wherein the latch is unitarily formed with the first lid section or the second lid section.

3. The storage device of claim 2, wherein the latch has a hook end and has a branch that is attached to the lid.

4. The storage device of claim 3, wherein the branch has a first end and a second end and wherein the first end and the second end are arranged on two different elevations when the storage device is stood upright.

5. The storage device of claim 1, wherein the casing comprises magnetic parts such that the first casing enclosure has an opposite magnetic pole than the second casing enclosure.

6. The storage device of claim 1, wherein the first casing enclosure has a first external surface with a first protruding pattern and the second casing enclosure has a second external surface with a second protruding pattern.

7. The storage device of claim 1, wherein the lid is attached to the casing by a hinge mechanism comprising a pivot pin.

8. The storage device of claim 7, wherein the pivot pin projects through two pivot holes of the casing.

9. The storage device of claim 8, wherein the pivot pin projects into two holding bores having closed ends on the lid.

10. The storage device of claim 1, wherein the casing has two side edges including a first side edge and a second side edge, and wherein a plurality of flared tabs extend outwardly from the first side edge and each flared tab comprising a receiving boss.

11. The storage device of claim 10, wherein a plurality of flared tabs extend outwardly from the second side edge and each flared tab comprising a receiving boss.

12. The storage device of claim 11, wherein a fastener passes through each of the receiving bosses.

13. The storage device of claim 12, wherein each flared tab comprises a flared tab first section attached to the first casing enclosure and a flared tab second section attached to the second casing enclosure.

14. The storage device of claim 1, wherein the first storage slot has two side railings defining a width, and wherein the cinematography lens filter is located inside the first storage slot and is spaced from at least one of two side railings.

15. The storage device of claim 14, wherein the first strip and the second strip are made from a foam material.

16. The storage device of claim 1, wherein portions of an end edge and portions of a side edge of the cinematography lens filter are exposed when the lid is rotated to an open position.

17. The storage device of claim 1, wherein the casing and the lid are made from a rigid material having a hardness value that is greater than that of the first and second strips.

18. A storage device for a cinematography lens filter, comprising:

a first casing enclosure, said first casing enclosure having a first side edge, a second side edge, a bottom edge, a first angled top edge, and a continuous lip structure protruding outwards from an inner surface of the first casing enclosure and extending along the first side edge, the bottom edge, and the second side edge of the first casing enclosure;

the first angled top edge inclining upwards from the first side edge of the first casing enclosure having a first hinge section to the second side edge of the first casing enclosure having a first portion of a latching mechanism;

the continuous lip structure making up railings along the first and second side edges of the first casing enclosure, the railings configured to receive cinematography lens filter side edges, the continuous lip structure forming part of an interior space for accommodating a first strip proximate the bottom edge of the first casing enclosure;

a second casing enclosure attachable to the first casing enclosure, said second casing enclosure having a first side edge, a second side edge, a bottom edge, and a second angled top edge inclining upwards from the first side edge of the second casing enclosure having a second hinge section to the second side edge of the second casing enclosure; and a lid having a top edge, an angled bottom edge, a first lid side, a second lid side, the angled bottom edge of the lid inclining upwards from the first lid side to the second lid side so as to conform and align with the first and second angled top edges, the second lid side having a second portion of the latching mechanism and a second strip located in an interior of the lid.

19. A storage device for a cinematography lens filter, comprising:

a casing having a two-part body including a first casing enclosure and a second casing enclosure joined together along a first parting line and defining a first storage slot with railings on a right inside side edge and a left inside side edge, the two-part body having a first portion of a latching mechanism near a top opening; and a rotatable lid attached to the casing and having a two-part body including a first lid section and a second lid section joined together along a second parting line and defining a second storage slot, the rotatable lid having a second portion of the latching mechanism on a lid side edge.

20. The storage device of claim 19, wherein an interface between the lid and the casing is angled from a hinge end at a first side edge of the casing and inclining towards a latched end at a second side edge of the casing.

* * * * *